United States Patent [19]

McCarthy et al.

[11] 4,045,630

[45] Aug. 30, 1977

[54] CHIN ACTIVATED SWITCH

[75] Inventors: Charles J. McCarthy, Rockville; Steven Charles; Daniel M. Eichenbaum, both of Bethesda, all of Md.

[73] Assignee: The United States of America as represented by the Secretary of the Department of Health, Education and Welfare, Washington, D.C.

[21] Appl. No.: 611,321

[22] Filed: Sept. 8, 1975

[51] Int. Cl.[2] ..... H01H 35/00; H01H 25/04

[52] U.S. Cl. ..... 200/52 R; 200/6 A; 200/DIG. 2

[58] Field of Search ..... 200/6 A, 18, 52 R, 61.41, 200/DIG. 2, 5 R; 318/466, 557, 543

[56] References Cited

U.S. PATENT DOCUMENTS

| | | | |
|---|---|---|---|
| 2,066,092 | 12/1936 | Brown | 200/DIG. 2 |
| 2,747,038 | 5/1956 | Perkovich | 200/DIG. 2 |
| 3,229,059 | 1/1966 | Beatty | 200/61.41 |
| 3,271,532 | 9/1966 | Lopez | 200/6 A |
| 3,293,381 | 12/1966 | Eitel | 200/6 A |
| 3,708,636 | 1/1973 | Sobchak | 200/6 A |
| 3,917,918 | 11/1975 | Vannest et al. | 200/6 A |
| 3,918,021 | 11/1975 | Nishioka et al. | 200/6 A X |

*Primary Examiner*—James R. Scott
*Attorney, Agent, or Firm*—Browdy and Neimark

[57] ABSTRACT

A chin activated switch for use in adjusting the movement of a binocular microscope along three orthogonal axes allows the operator to utilize his hands and feet to control other devices. This chin switch contains a plurality of microswitches which are activated by specific movements of the chin. A chin plate upon which the operator's chin rests is connected to a pivot rod and rocker assembly the movement of which actuates the microswitches. These microswitches in turn control motors which move the microscope in the desired directions.

8 Claims, 6 Drawing Figures

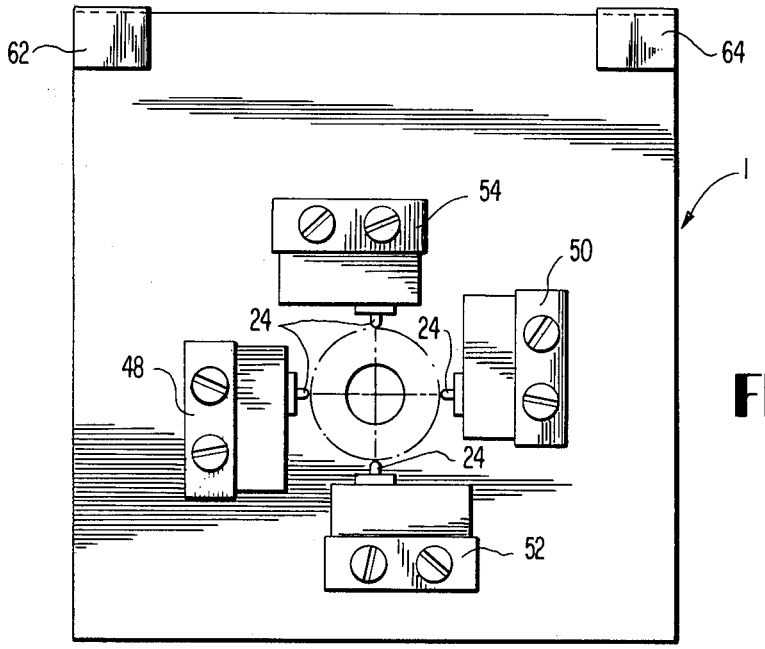
FIG. 4
FIG. 5
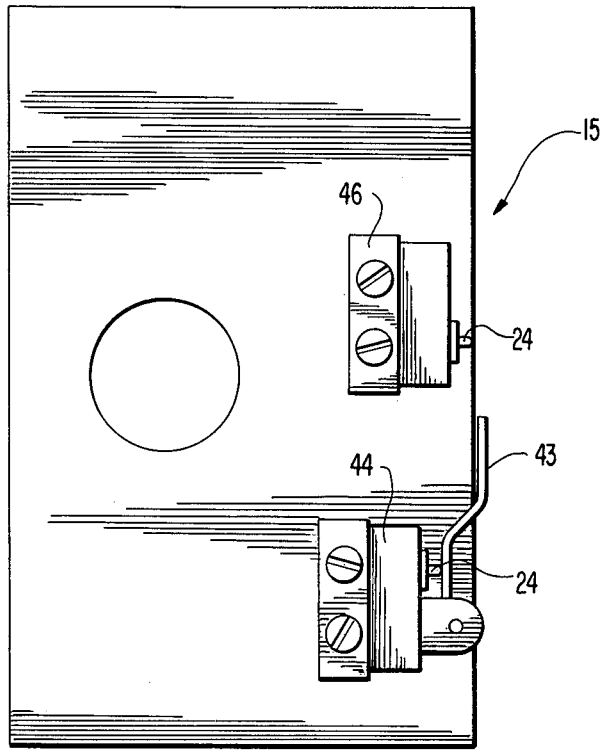

CHIN ACTIVATED SWITCH

FIELD OF THE INVENTION

This invention relates to a chin activated switch which is used in directing the movement of a binocular microscope or other surgical equipment and has particular utility in vitreous surgery.

BACKGROUND OF THE INVENTION

In vitreous surgery, the surgeon generally holds a vitrectomy instrument in one hand and either traction sutures, an irrigated contact lens, or a second surgical device in the other hand. While operating, the surgeon must also use a high-powered binocular microscope and frequent repositioning of this microscope is necessary because of its high magnification and small field of view. These repositionings are usually accomplished by a foot operated motorized microscope movement. These foot switches can operate in the X-Y (left-right, in-out) directions as well as focusing and zooming. (See "A New Concept for Vitreous Surgery" authored by Parel, Machemar and Aumayr appearing in The American Journal of Ophthalmology, Feb. 19, 1974.)

However, several disadvantages have been noted in the utilization of these foot switches to operate the X-Y and focus (Z) functions of the microscope. This is due to the fact that it is quite difficult for the surgeon to lift his leg to position his foot on the various foot switches without slightly shifting his body and hand position. In addition, this type of foot switch does not permit simultaneous movement of the microscope in two or three directions. The use of one foot to constantly control the microscope, forces the other foot to operate the various surgical modalities such as the vitrectomy instrument, intravitreal cautery, intravitreal cryothermy, remote suction, and photography equipment, thus prohibiting simultaneous operation of any two of these modalities.

SUMMARY OF THE INVENTION

It is accordingly an object of the present invention to overcome the defects of the prior art as mentioned above.

Another object is to provide for improved surgical efficiency.

Yet another object is to provide for improved control of a binocular microscope during surgery.

Another object of the present invention is to develop a switch which can be operated by the chin of the user.

A further object of the present invention is to develop a chin switch which may be used to position the field of view of a binocular microscope.

Still another object of the present invention is to provide a chin switch containing a pivot rod and rocker assembly.

Yet another object of the present invention is to provide a chin switch which can easily be plugged into existing equipment.

A chin operated switch is accordingly provided to control the X-Y-Z positioning motors of a binocular microscope system. The chin was chosen to activate these motors because of its ability to move independently in all three orthogonal axes (up-down, left-right, and forward-backward) without head, eye, body, or hand movement.

This device includes a plurality, e.g. six, of microswitches which are arranged along the three axes (X-Y-Z) and which are mounted on rocker plate assembly or the housing. This assembly is activated by movement of a padded disk upon which the operator's chin rests. A seventh microswitch can be provided to disconnect the −Y circuit when the chin is completely removed from the chin plate. The position of the chin switch is adjustable to permit its utilization by surgeons having varying facial dimensions. Furthermore, the amplitude and force of the required movement to operate each switch is also adjustable. The switching logic employed is such that moving the chin upward raises the microscope, moving the chin downward lowers the microscope, etc., so that minimum practice is necessary to master the operation of the switch. Simultaneous movement in two or three directions is easily accomplished and significantly decreases microscope positioning time.

Since this device is particularly adapted to be used in conjunction with standard operating instruments, a further object is to avoid modifications of this existing equipment and to avoid interface devices such as optics to electronics or signal level to power level solid state or electrical-mechanical relays. Therefore, simple, commercially available switches to turn on and off the existing motors which move the microscope field of view along the three orthogonal axes have been utilized. In particular, it is possible to plug the chin switch lead into the same receptacle which was formerly used to plug in the foot switches described in the cited prior art journal.

BRIEF DESCRIPTION OF THE DRAWING

The above and additional objects and advantages of the present invention will become more apparent by reference to the description of an illustrated embodiment in a drawing thereof in which:

FIG. 4 is a front view of the rocker plate of the devices of FIGS. 1–3;

FIG. 5 is a top view of the switch assembly housing bottom of the device of FIGS. 1 and 2.

DETAILED DESCRIPTION OF A PREFERRED EMBODIMENT

Figure 1:
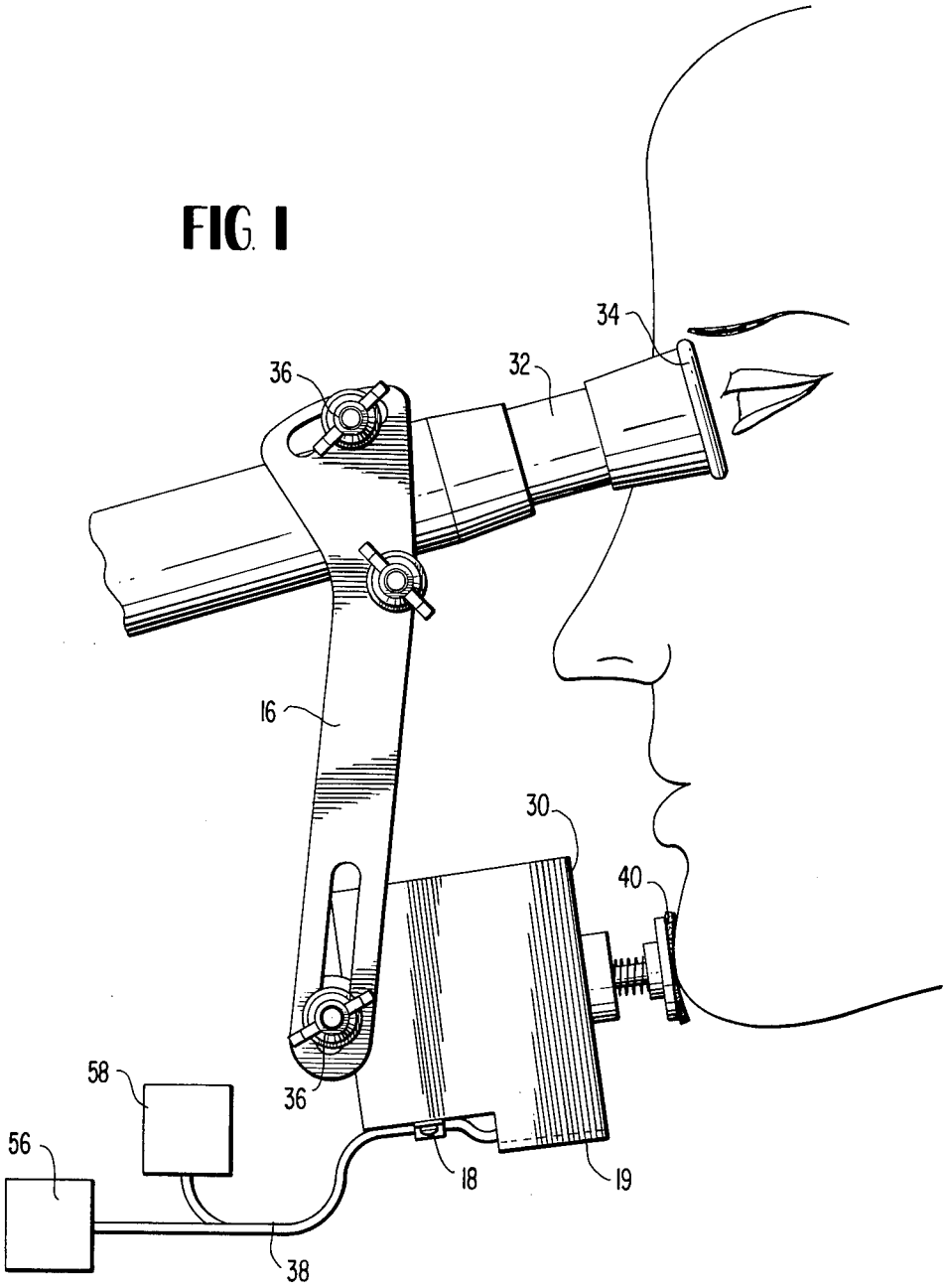
FIG. 1 is a side view of an entire device in accordance with the present invention including the microscope.

FIG. 1 shows an entire chin switch assembly 30 in operational use in conjunction with a binocular microscope 32. As here shown, when the surgeon peers through an eyepiece 34 of the microscope 32, his chin rests upon a chin pad 40 which is part of a chin pad assembly 3 associated with the switch assembly 30. According to the field of view which the surgeon desires, his chin can be moved in the ±X direction (left or right), the ±Y direction (in or out), or the ±Z direction (up or down), such movement serving to activate one or more microswitches. The operation of these microswitches 44, 46, 48, 50, 52 and 54 in conjunction with the chin movement of the surgeon will be discussed hereinbelow.

The assembly 30 is provided with a wire cover 19 and an anchor screw 18 for use in conjunction with electrical wires 38. These wires are connected to the microswitches and activate the microscope movement by connection with X and Y motors contained in housing 56 or a Z motor contained in housing 58.

The assembly 30 is connected to the microscope 32 by use of an adjustable slotted bracket 16 through which pass suitable retaining bolts 36 cooperating with a number of winged locking nuts. It is important that the bracket 16 be adjustable in order to permit utilization by surgeons having varying facial dimensions. The bracket 16 as well as the other components can be constructed of any suitably strong and lightweight material such as standard aluminum alloy, titanium, magnesium or like material or even plastic.

Figure 2:
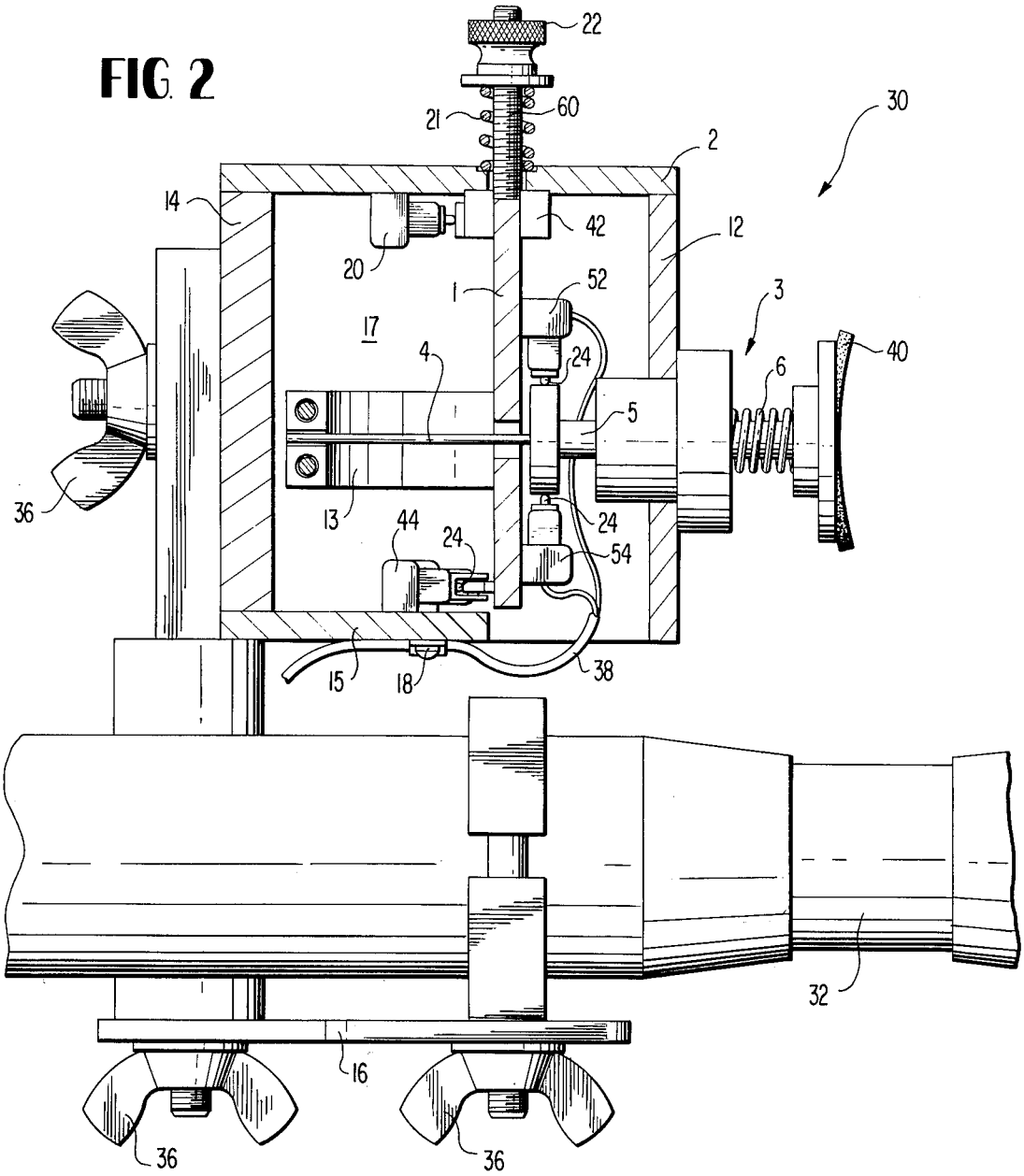
FIG. 2 is an enlarged sectional view of the entire device of FIG. 1.

FIG. 2 shows an enlarged sectional view of the chin switch assembly. The assembly 30 consists of a housing front 12, a housing rear 14, a housing top 2, and a housing bottom 15 which can be constructed of a suitable durable material such as a black anodized aluminum alloy. A pair of sides 17 are provided and can be constructed of plexiglass, although this is not mandatory.

Figure 3:
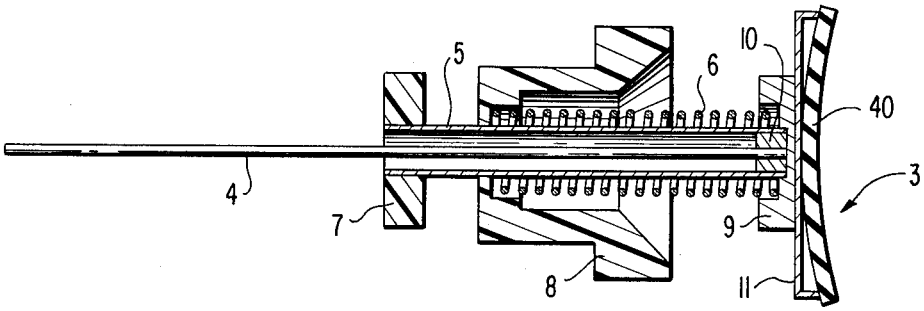
FIG. 3 is a sectional view of the chin plate and pivot rod assembly of FIGS. 1 and 2.

The chin pad 40 is constructed of any soft foam rubber material and is bonded to a support plate 11 which also forms part of the chin pad subassembly 3. As shown in FIG. 3, this support plate 11 is bonded or otherwise attached to a fastening element 9 which is provided with a hollowed-out portion to allow for the insertion of a fastening element 10. These fastening elements 9 and 10 merely hold the chin support 11 to a pivot lever 5 and push rod 4 in such a manner so as to allow easy replacement of the push rod 4 in case it comes broken due to mishandling. These elements 9 and 10 can be constructed of aluminum alloy or other suitable material which provides the needed strength.

To provide optimum operability, the push rod 4 is a thin-walled, metal tube whose length, diameter, wall thickness and material are chosen so that it can transmit push forces without buckling and can be slightly bent into a strung out S shape to avoid the need for universal joints on each end. Furthermore, such particular construction enables the push rod 4 during usage to be bent and pushed simultaneously without buckling. The purpose of this rod is to eliminate all forms of sliding friction while transmitting either a push or pull force to a rocker plate, the function of which will be discussed in more detail below.

The cylindrical pivot lever 5 encircles the half of push rod 4 closest to the chin pad 40. This lever is a rigid tube which is surrounded by a fixture 8 having an annular surface contacting the lever 5, which annular surface acts as a pivot point at some place between the end points of the tubular pivot lever 5. This pivot point completely surrounds the lever so that the lever action can be in any direction throughout a 360° circle.

A toroidal shaped contact part 7 surrounds the distal end of the pivot lever 5 and therefore surrounds the push rod 4 at approximately its mid-section. By pushing down on the proximal end of the lever 5 at the chin pad 40, the distal end moves upwardly so that contact part 7 moves up to contact a switch button 24 on the $-Z$ microswitch 52. It should be thus noted that if the proximal end of the lever 5 is pushed upward, then the contact part 7 would activate a switch button 24 of the $+Z$ microswitch 54.

The above described lever action is accomplished with a slight bending of push rod 4 which passes through the center of the pivot lever 5 without contacting that center surface. Because of the flexibility of the push rod 4, the contact part 7 can be moved freely within its circle of operation while being held a fixed distance from the distal end of the push rod 4. It should be noted that contact part 7 must be large enough in diameter so that the switch buttons 24 push on, or nearly on a radius line of part 7. In this manner, it can be seen that more than one switch button 24 can be actuated at the same time and, therefore, the microscope can be moved in more than one direction at any one time. Although the exact dimensions are not mandatory, the push rod 4 can be constructed of a stainless steel tube whose diameter and wall thickness are included in the gauge 23 designation and whose length is 2½ inches.

The distal end of the push rod 4 is encircled by a cylindrical bracket 13 which is used to attach the distal end of push rod 4 to the rocker plate 1. The purpose of this bracket 13 is to bridge the length of push rod 4 which extends beyond the rocker plate 1. This bracket 13 can be constructed of most any metal which has a good strength to weight ratio.

The fixture 8 also acts as an adjustment screw for adjusting the force in a tipping spring 6 which encircles a substantial portion of the pivot lever 5 and which is connected in the fastening element 9. If the housing front 12 is constructed of aluminum, this fixture 8 should be constructed of a plastic such as Delrin so that the screw thread can be made tight, but non-galling. This construction assures that adjustments will not slip, but will still be easy to facilitate.

The function of the tipping spring 6 is to apply a force which causes the rocker plate 1 to lean toward the operator. One end of this tipping spring 6 pushes on the fastening element 9 which is connected to the chin pad 40. The force is then transmitted through push rod 4 and bracket 13 to the rocker plate 1. The other end of the tipping spring 6 pushes through the fixture 8 to the housing part 12. Therefore, the operator must overcome part of this tipping force in order to rock the rocker plate 1 into a detent position (the position when the rocker plate 1 is substantially perpendicular to the housing part 2). The tipping spring force is also opposed by a stabilizing spring 21 which encircles a screw 60 which is in turn in contact with the rocker plate 1. As is shown in FIG. 2, the stabilizing spring 21 can be adjusted by a thumbscrew adjuster 22. It should be noted that the screw 60 engages the rocker plate 1 within the assembly housing 30 but that the stabilizing spring 21 encircles the thumbscrew 60 on the portion outside of the housing. Therefore, it can be seen that the operator must overcome all of the tipping spring force plus the stabilizing spring force in order to rock the rocker plate beyond its detent position.

The main purpose of the rocker plate 1 is to achieve this detent position in such a manner so that it can be perceived by the operator. The rocker plate 1 is best depicted in FIGS. 2 and 4 and is essentially rectangular in configuration but includes a broad base 42 formed by four external corners, two of which 62 and 64 are shown in FIG. 4. The other two external corners which are not shown in the drawing are directly behind the two corners which are shown. Because of the direction of the force of stabilizing spring 21, the broad base 42 holds the rocker plate 1 in a stable position which is perpendicular to the housing top 2. This action is comparable to a chair whose four legs form a broad base and whose weight acts in a proper direction for holding the chair perpendicular to the floor.

Figure 6:
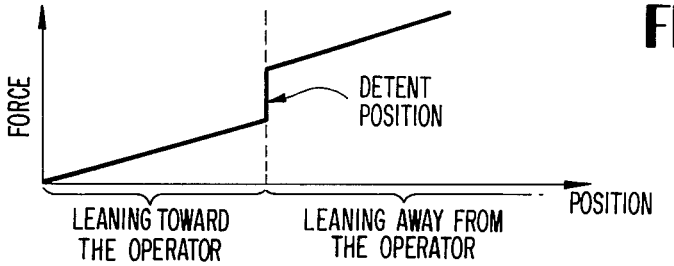
FIG. 6 is a graph illustrating the force needed to move the rocker plate to and from its detent position.

The tipping spring 6 overcomes the stabilizing force of spring 21 and causes the rocker plate 1 to lean toward the operator. If the operator pushes on the chin pad 40 until the rocker plate returns to the detent position, he can perceive this position since the rocker plate ceases moving and will not move again until the chin pad force is increased by a significant amount. An operator pushing on the chin pad automatically perceives these sensations of force and motion so that he continuously knows whether the rocker plate 1 is in its detent position. FIG. 6 shows the force on the chin pad versus the distance the rocker plate leans from one extreme to the other.

In order to insure optimum operability, the force of springs 6 and 21 can be adjusted to the preference of the operator. If there is no operator-applied force, the rocker plate 1 leans toward the operator and by applying a preferred amount of force, the rocker plate can then be held in a vertical position without leaning in either direction. This preferred amount of force is actually a range adjusted by balancing the two springs 6 and 21 so that the operator must apply a significant extra force to rock the plate away from him and a significant reduction in force to allow the plate to lean toward him. In other words, the detent position of rocker plate 1 is an easily perceived position which can be maintained without developing special skills.

The rocker plate 1 can activate a pullout switch 20, the −Y microswitch 44 and the +Y microswitch 46. The pullout switch 20 contains a switch button 24 which abuts the broad base 42 of the rocker plate 1 and which is attached to the housing top 2. The +Y and −Y microswitches 46 and 44 respectively are attached to the housing bottom as is shown in FIG. 5. The −Y microswitch 44 is activated by a lever 43. (In this case an activated or depressed switch button opens an electric circuit for the Y motor.) This lever 43 is necessary since the −Y direction microswitch 44 is to be actuated before the rocker plate 1 reaches its detent position and must remain activated as the +Y microswitch is activated.

These three microswitches (±Y microswitches 46 and 44 and pullout switch 20) which are directly actuated by the rocker plate 1 will be actuated in the following manner. If there is no operator-applied force, and with the rocker plate 1 leaning toward the operator, none of the switches is activated and the Y-motor is off. As force is first applied by the operator, the "pullout" switch 20 is activated and the Y-motor runs in the minus direction. As additional force is applied and the rocker plate 1 moves toward the straight position detent, the −Y microswitch 44 is activated and the Y-motor is turned off. The −Y microswitch adjustment should be made so that the switch is always activated when the rocker plate 1 is in the detent position, but not activated appreciably before the rocker plate attains this detent position. . Further, as excess force is applied and the rocker plate 1 moves out of the detent position and away from the operator, the +Y switch 46 is activated and the Y-motor runs in the positive direction.

In summary, the location of the three switches and adjustment of the two springs should be made so that leaning the rocker plate 1 in either direction from its detent position causes one or the other of the ±Y switches to change with the corresponding motor running direction; and a large motion of the rocker plate toward the operator (removal of applied force), causes a deactivation of the pullout switch 20 with the corresponding motor off condition.

The pullout switch 20 is electrically connected in series to the −Y microswitch 44 so that this microswitch is enabled only when the pullout switch 20 is activated. Therefore, even though the switch button of the −Y microswitch is out when there is no force applied to the chin pad 40, the −Y motor circuit is not activated since the pullout switch 20 has not yet been activated. Furthermore, when the operator moves his chin off the chin pad 40, the pullout switch 20 will disable the −Y microswitch circuit.

It can be appreciated that the pullout switch 20 is only needed to achieve two separate positions of the rocker plate 1 which correspond to no motion of the Y-axis motor, e.g., the detent position and the pullout position. Otherwise, the pullout switch 20 would not be needed, and applying an increasing force to rocker plate 1 would cause the Y-motor to go from off to −Y to +Y with −Y corresponding to the detent position of the rocker plate 1.

A second purpose of the rocker plate 1 is to achieve an adequate separation between the in-out adjustments and the up-down, left-right adjustments. An operator may push in on or reduce the force on the chin pad 40 to effect the change in one of the Y microswitches 44 or 46 with or without a change in one of the X or Z switches as he chooses. It is also possible to actuate a switch on each of the three axes simultaneously or to actuate any one switch without physically touching the switch buttons of any of the other switches. In other words, pushing the chin pad 40 to rock the rocker plate 1 does not require an element to slide past or rub against any of the X or Z switches. This feature was incorporated in order to avoid any frictional forces that might partially obscure the feel that an operation should have when the operator causes the depressing or releasing of any of the switch buttons 24.

As is shown in FIG. 4, the rocker plate 1 also serves as a surface on which to mount the +X microswitch 48, the −X microswitch 50, the +Z microswitch 52 and the −Z microswitch 54. The rocker plate 1 may be made of any rigid material, but it has been found that aluminum alloy is a good choice due to its lightness and easy workability in machine shops equipped with lathes and milling machines. The two Z microswitches 52 and 54 are mounted directly upon the rocker plate 1, but they are constructed so that the portion of the switches containing the switch buttons 24 are elevated slightly from the rocker plate 1 therefore maintaining clearance between this plate and the contact part 7. Although it is not shown in the drawings, a similar design is employed in the mounting of the two X microswitches 48 and 50.

The rocker plate 1 abuts the housing top 2 and since this plate is displaced toward or away from the operator, the housing top 2 has a flat bottom groove to allow the plate 1 to rock, but not to be translated to a different location. This groove has angled sides so as to avoid any rubbing as one or the other of the rocker plate corners is raised off the flat bottom surface. A through slot in housing top 2 allows the screw 60 in the rocker plate 1 to extend through the housing without rubbing contact. A blind hole centered around the through slot locates the stabilizing spring 21 which loads the rocker plate 1 against the housing top 2 in a stable perpendicular position. This housing top is also provided with mounting holes for mounting the pullout switch 20.

The above-described chin switch can be operated in the following manner. During a vitrectomy operation, the operator places his chin upon the chin plate 40 while viewing the field of operation through the binocular microscope 32. If the operator desires to change the field of view, pressure is applied through his chin in the manner in which he requires the microscope to move. In other words, if he wishes the microscope to focus closer to the eye of the patient, he would move his chin downward and if greater distance from the patient is needed, he would move his chin upward. Similarly, if he desires the microscope to move toward him, he would reduce his pressure on the chin switch and if he wants the microscope to move away from him, he would increase his chin pressure. Furthermore, if he wishes to move the microscope to the right or to the left, he will move his chin in a like manner. The movement of the chin in the X or Z direction would force the lever 5 to move so that the contact part 7 depresses the correct switch button which in turn activates the correct microswitch or microswitches. These microswitches are attached to their appropriate motors through electrical connections 38 and therefore the field of view of the microscope will be moved.

If the operator desires to move the field of view in the Y direction, he applies or reduces pressure in that direction which would consequently activate the appropriate microswitch. This microswitch would then in turn close the proper circuit of the Y directional motor and the field of the microscope would be appropriately changed.

While this device has been described with particular utility with a binocular microscope, it should not be construed to be so limited and may be utilized with many other surgical instruments. It will be obvious to those skilled in the art that various changes may be made without departing from the scope of the invention and the invention is not to be construed as limited to what is shown in the drawings and described in the specification.

What is claimed is:

1. A device for controlling movement of an instrument along three orthogonal axes by movement of the chin of an operator, comprising:

a chin plate for placement against the chin of the operator;

motor means for driving the instrument along three orthogonal axes and controlled by the location of said chin plate; and means for converting movements of said chin plate to signals for said motor means, comprising a pivot lever connected to and extending from said chin plate; a push rod lying within said pivot lever and extending from said chin plate, said push rod being sufficiently rigid to transmit push forces without buckling and being sufficiently flexible to bend; a rocker plate connected to said push rod and extending generally perpendicular thereto; support means to retain one end of said rocker plate stationary relative to movement of said chin plate, said push rod and said pivot lever; first switch means mounted on said support means adjacent said rocker plate for activating said motor means to move the instrument along one of the three orthogonal axes due to movement of said rocker plate; and second and third switch means lying on said rocker place adjacent said pivot lever for activating said motor means to move the instrument along two of the three orthogonal axes due to movement of said pivot lever in a direction parallel to the plane of said rocker plate.

2. A device according to claim 1 further including:

a stabilizing spring cooperatively engaged with said rocker plate and said support means for causing said rocker plate to lean neither toward or away from the operator; and a tipping spring encircling a portion of said pivot lever and supported by said support means and acting in opposition to the force of said stabilizing spring.

3. A device according to claim 2 further comprising means for adjusting the tension in said tipping spring.

4. A device according to claim 1 wherein:

said push rod comprises a thin walled metal tube which can be simultaneously bent and pushed without buckling;

a bracket means adjacent to a portion of said metal tube furthermost from said chin plate for connecting the end of said tube to said rocker plate; and depressing means encircling said pivot lever for activating said second and third switch means.

5. A device according to claim 1 wherein the instrument which is moved is a microscope.

6. A device in accordance with claim 1, wherein said pivot lever and said push rod both extend generally horizontally from said chin plate, and said rocker plate is disposed generally vertically, said rocker plate having an opening therethrough with said push rod extending beyond the distal end of said pivot lever and extending through the opening in said rocker plate; said rocker plate being connected to said push rod at the distal end thereof with a bracket means; said device further comprising depressing means mounted on the distal end of said pivot lever through which said pivot lever effects activation of said second and third switch means.

7. A device in accordance with claim 6, wherein said second and third switch means comprise four switches mounted on said rocker plate around the opening through said rocker plate, said four switches being disposed 90° from one another, said depressing means being of circular configuration of diameter slightly less than the diameter of a circle defined by the spacing of said four switches.

8. A device in accordance with claim 1, wherein said motor means comprises three motors, one motor each to control movement along one of said three orthogonal axes; said first switch means comprising a first switch, a second switch and a third switch said first switch serving to turn on one of said motors, said second switch serving to run said motor in one direction and said third switch serving to run said motor in the opposite direction.

* * * * *